US011532911B2

(12) United States Patent
Zhang et al.

(10) Patent No.: US 11,532,911 B2
(45) Date of Patent: Dec. 20, 2022

(54) CONNECTING DEVICE AND ASSEMBLY OF CONNECTING DEVICE AND MATING DEVICE

(71) Applicant: NEXTRONICS ENGINEERING CORP., New Taipei (TW)

(72) Inventors: Yong Zhang, Guangdong (CN); Liang-Ju Liang, Guangzhou (CN)

(73) Assignee: NEXTRONICS ENGINEERING CORP., New Taipei (TW)

( * ) Notice: Subject to any disclaimer, the term of this patent is extended or adjusted under 35 U.S.C. 154(b) by 56 days.

(21) Appl. No.: 17/373,784

(22) Filed: Jul. 13, 2021

(65) Prior Publication Data

US 2022/0320796 A1 Oct. 6, 2022

(30) Foreign Application Priority Data

Mar. 30, 2021 (CN) ..... 202110339627.X

(51) Int. Cl.

| | |
|---|---|
| ***H01R 13/62*** | (2006.01) |
| ***H01R 13/627*** | (2006.01) |
| ***H01R 9/03*** | (2006.01) |
| ***H01R 9/22*** | (2006.01) |

(52) U.S. Cl.

CPC ..... *H01R 13/6277* (2013.01); *H01R 9/03* (2013.01); *H01R 9/223* (2013.01); *H01R 13/6205* (2013.01)

(58) Field of Classification Search

CPC .. H01R 13/6277; H01R 13/6205; H01R 9/03; H01R 9/223; H01R 33/46

See application file for complete search history.

(56) References Cited

U.S. PATENT DOCUMENTS

| | | | | |
|---|---|---|---|---|
| 5,399,096 | A * | 3/1995 | Quillet | H01R 13/622 439/321 |
| 5,873,737 | A * | 2/1999 | Hashizawa | H01R 13/6205 439/39 |
| 6,848,930 | B2 * | 2/2005 | Fukuda | H01R 13/6277 439/271 |
| 7,857,651 | B2 * | 12/2010 | Chen | H01R 13/6584 439/352 |
| 9,099,807 | B2 * | 8/2015 | Opgenorth | H01R 13/62 |
| 9,893,451 | B2 * | 2/2018 | Zhang | H01R 13/6205 |
| 10,297,950 | B2 * | 5/2019 | Wei | A41D 13/0051 |
| 10,490,937 | B1 * | 11/2019 | Su | H01R 24/64 |
| 10,734,761 | B1 * | 8/2020 | Su | H01R 13/533 |
| 11,165,196 | B2 * | 11/2021 | Yonnet | H01R 13/631 |
| 11,264,763 | B1 * | 3/2022 | Su | H01R 13/6275 |

* cited by examiner

*Primary Examiner* — Thanh Tam T Le

(74) *Attorney, Agent, or Firm* — Li & Cai Intellectual Property Office

(57) ABSTRACT

A connecting device and an assembly of the connecting device and a mating device are provided. The connecting device includes an insulating main body, a plurality of terminals, a magnet set, an inner housing, a crown leaf spring, an outer housing, and a wave spring. The plurality of terminals are disposed on the insulating main body, the magnet set is disposed on the insulating main body, and the inner housing is sleeved around the insulating main body. The wave spring and the crown leaf spring are each disposed between the inner housing and the outer housing, and abut the inner housing, so that the insulating main body, the plurality of terminals, the magnet set, and the inner housing are arranged in a floating state.

16 Claims, 11 Drawing Sheets

CONNECTING DEVICE AND ASSEMBLY OF CONNECTING DEVICE AND MATING DEVICE

CROSS-REFERENCE TO RELATED PATENT APPLICATION

This application claims the benefit of priority to China Patent Application No. 202110339627.X, filed on Mar. 30, 2021 in People's Republic of China. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a connecting device and an assembly of a connecting device and a mating device, and more particularly to a connecting device and an assembly of a connecting device and a mating device in which corresponding terminals are capable of being firmly in contact with each other when the connecting device is mated with the mating device through magnetic attraction.

BACKGROUND OF THE DISCLOSURE

A way of magnetic attraction is available for connecting conventional connecting devices to mating devices. In addition, an insulating main body and terminals of the connecting device can also be disposed in an outer housing in a floating manner, so that when the connecting device is mated with the mating device, corresponding terminals can still be in contact with each other even in the presence of a greater mechanical tolerance. Although the insulating main body and the terminals can be disposed in the conventional connecting device in the floating manner, the corresponding terminals may easily deviate from each other when the connecting device is mated with the mating device. Accordingly, the corresponding terminals cannot be firmly in contact with each other, resulting in poor electrical transmission.

SUMMARY OF THE DISCLOSURE

In response to the above-referenced technical inadequacy, the present disclosure provides a connecting device and an assembly of the connecting device and a mating device. When the connecting device is mated with the mating device, a better floating effect and a guiding effect can be provided. Terminals of the connecting device are firmly mated with the corresponding terminals of the mating device, so that the corresponding terminals are firmly in contact with each other, resulting in a better electrical transmission.

In one aspect, the present disclosure provides a connecting device, which includes an insulating main body, a plurality of terminals, a magnet set, an inner housing, a crown leaf spring, an outer housing, and a wave spring. The plurality of terminals are disposed on the insulating main body. The magnet set is disposed on the insulating main body. The inner housing has an inner housing main body, and the inner housing main body is sleeved around the insulating main body. The crown leaf spring is disposed on the inner housing. The crown leaf spring has a ring body and a plurality of elastic parts, and the plurality of elastic parts are disposed on the ring body at intervals. The outer housing is sleeved around the inner housing, and the plurality of elastic parts of the crown leaf spring abut the outer housing. The wave spring is disposed between the inner housing and the outer housing, such that the insulating main body, the plurality of terminals, the magnet set, and the inner housing are held on the outer housing by the crown leaf spring and the wave spring to form a floating member.

In another aspect, the present disclosure provides an assembly of a connecting device and a mating device. The assembly includes the abovementioned connecting device and a mating device. The mating device includes an insulating base body, a plurality of mating terminals, a mating magnet set, and a mating housing. The plurality of mating terminals are disposed on the insulating base body, the mating magnet set is disposed on the insulating base body, and the mating housing is sleeved around the insulating base body. When the connecting device is mated with the mating device, the plurality of terminals are correspondingly in contact with the plurality of mating terminals, so that the connecting device is electrically connected to the mating device, and the magnet set is fixed to the mating magnet set through a magnetic attraction.

Therefore, one of the beneficial effects of the present disclosure is that, the connecting device of the assembly of the connecting device and the mating device provided by the present disclosure includes the insulating main body, the plurality of terminals, the magnet set, the inner housing, the crown leaf spring, the outer housing, and the wave spring. The crown leaf spring has the ring body and the plurality of elastic parts, and the plurality of elastic parts are disposed on the ring body at intervals. The crown leaf spring is disposed on the inner housing, and the plurality of elastic parts of the crown leaf spring abut the outer housing. The wave spring is disposed between the inner housing and the outer housing, such that the insulating main body, the plurality of terminals, the magnet set, and the inner housing are held on the outer housing by the crown leaf spring and the wave spring to form the floating member. When the connecting device is mated with the mating device, the effects of floating and guiding can be provided. The crown leaf spring can be used to hold the inner housing, such that the inner housing is disposed on the outer housing in a floating way. The plurality of elastic parts surround the inner housing, so as to abut the outer housing, thereby forming a multi-point support. In addition, the inner housing is held and disposed on the outer housing in the floating way through the cooperation of the wave spring and the crown leaf spring, so as to achieve better effects of floating and guiding. Accordingly, the terminals of the connecting device are firmly mated with the corresponding terminals of the mating device, so that the corresponding terminals are firmly in contact with each other, resulting in the better electrical transmission.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
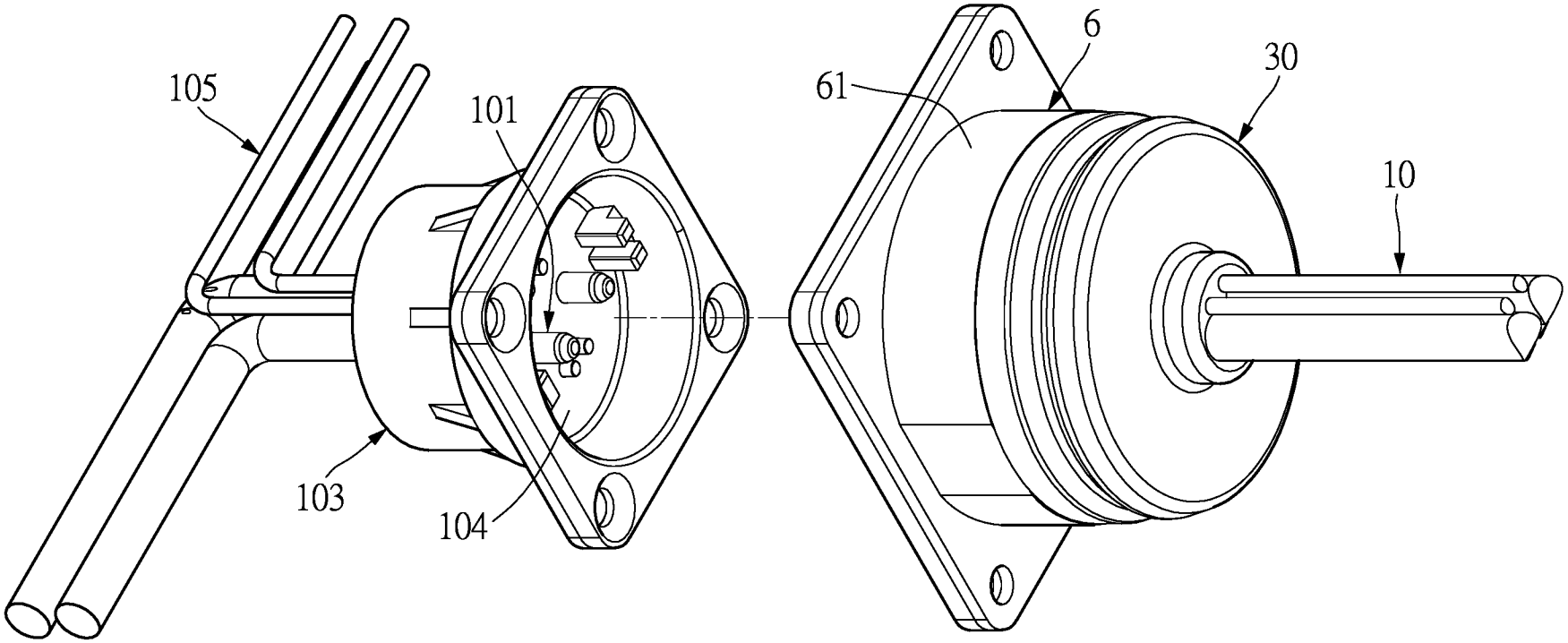
FIG. 1 is a schematic perspective view of a connecting device and a mating device according to the present disclosure.
Figure 2:
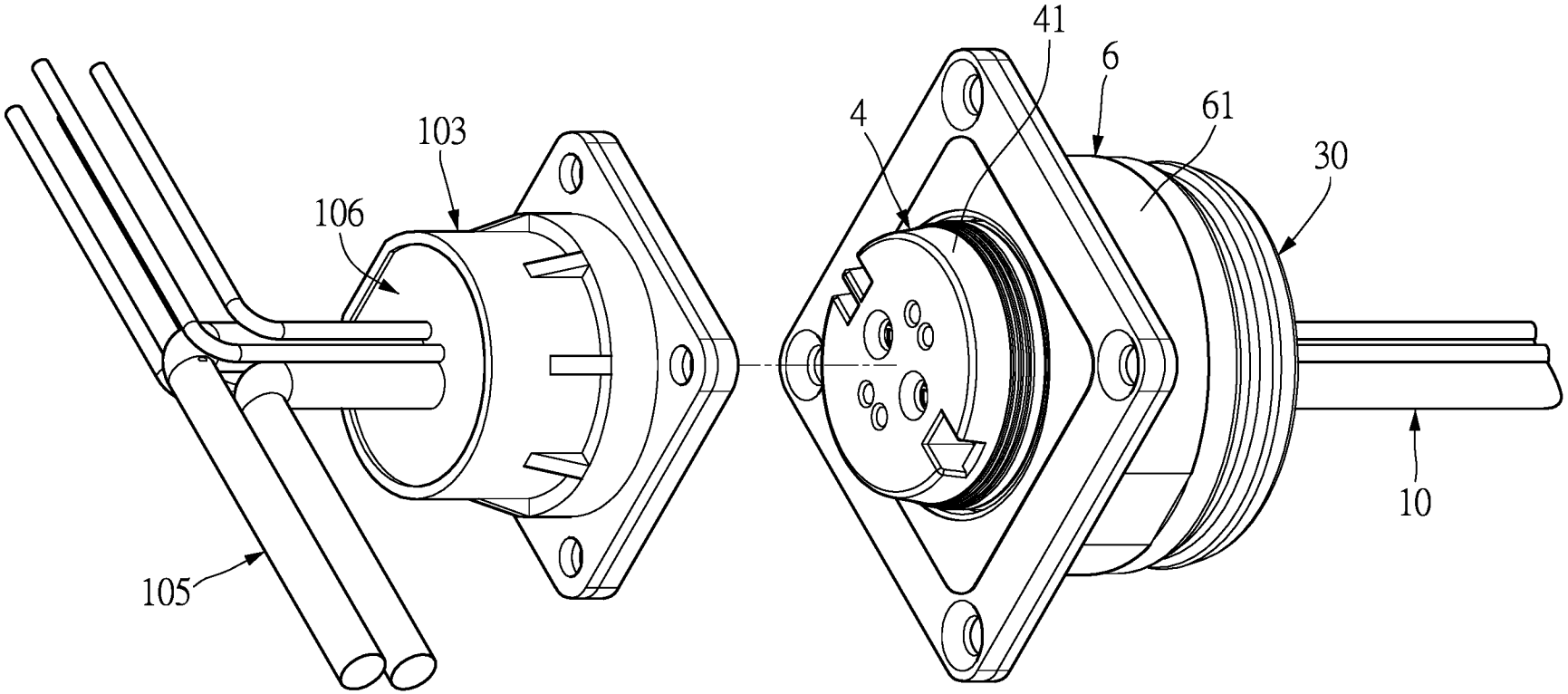
FIG. 2 is a schematic perspective view from another angle of the connecting device and the mating device according to the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 3:
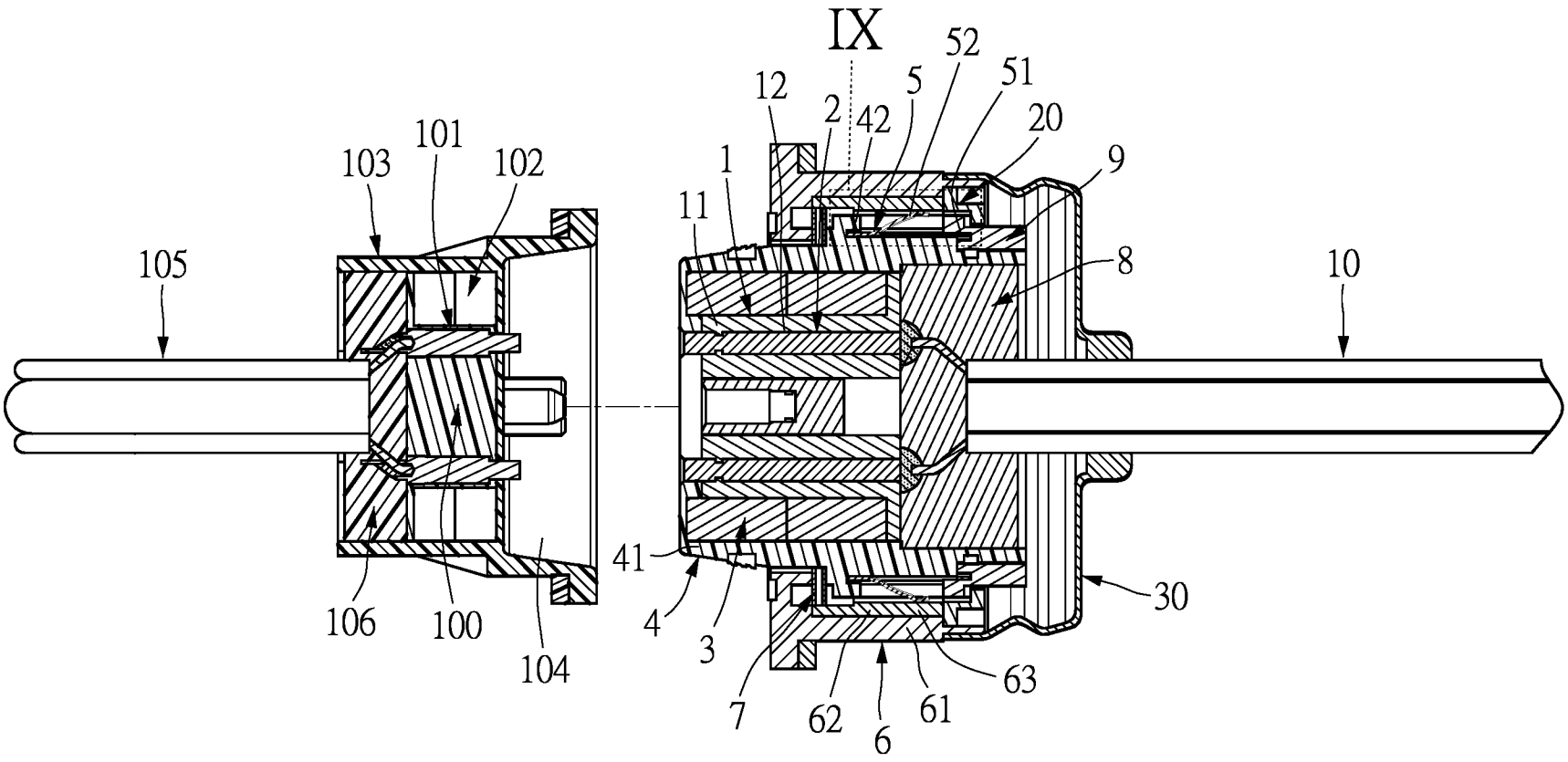
FIG. 3 is a schematic sectional view of the connecting device and the mating device according to the present disclosure.
Figure 4:
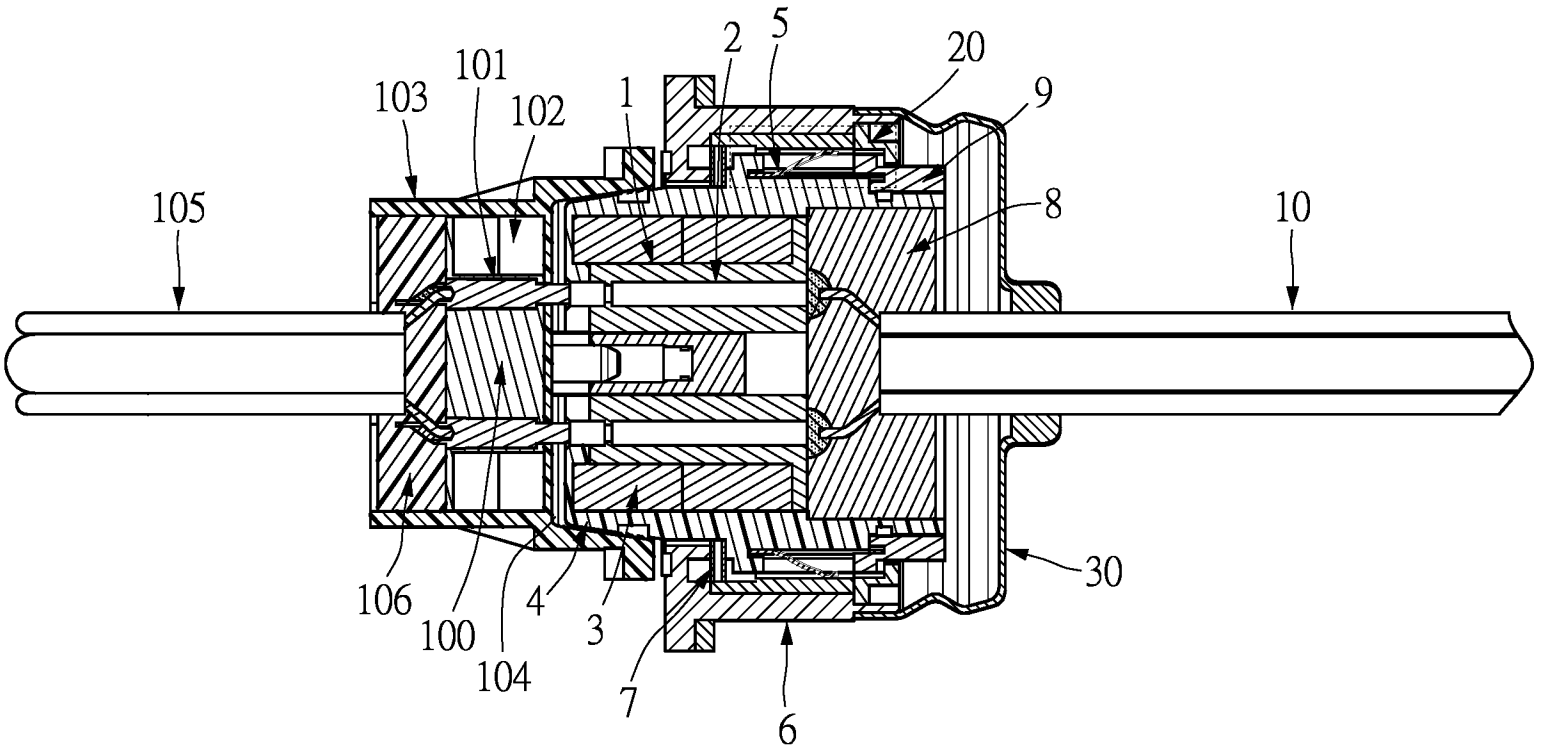
FIG. 4 is a schematic sectional view of the connecting device being mated with the mating device according to the present disclosure.
Figure 5:
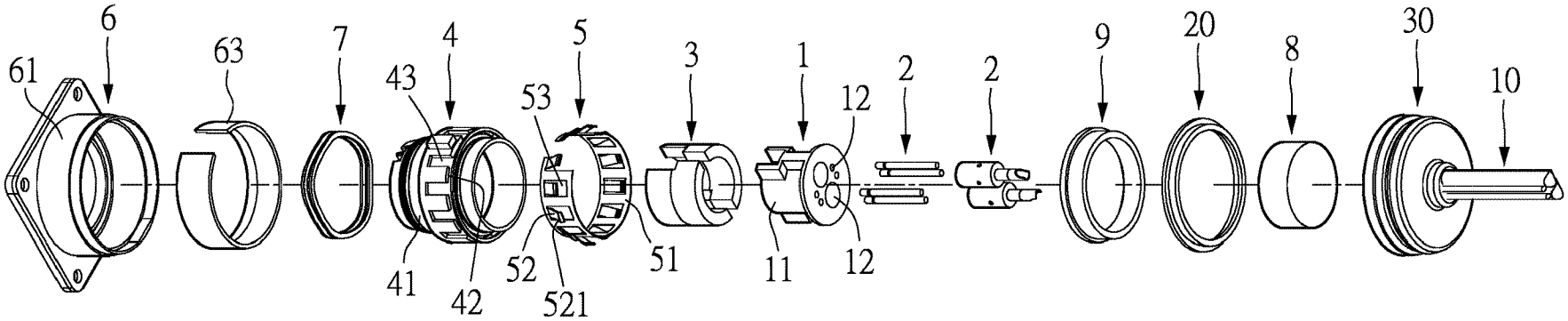
FIG. 5 is a schematic exploded view of the connecting device according to the present disclosure.
Figure 6:
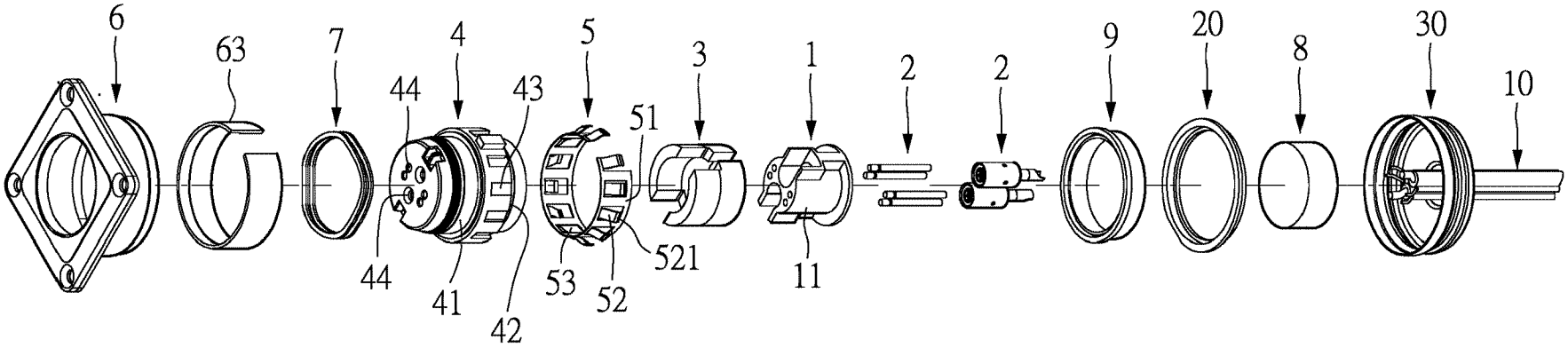
FIG. 6 is a schematic exploded view from another angle of the connecting device according to the present disclosure.

Referring to FIG. 1 to FIG. 4, which is to be read in conjunction with FIG. 5 and FIG. 6, the present disclosure provides a connecting device, which can be mated with a mating device (i.e., a connector). The connecting device includes an insulating main body 1, a plurality of terminals 2, a magnet set 3, an inner housing 4, a crown leaf spring 5, an outer housing 6, and a wave spring 7.

In the present disclosure, a "front end" refers to an end toward the mating device (i.e., the connector), and a "rear end" refers to an end away from the mating device (i.e., the connector), that is, an end toward a mating direction is defined as the "front end", and an end away from the mating direction is defined as the "rear end".

The insulating main body 1 is made of a plastic material and is an insulator. The insulating main body 1 can have a main body part 11 and a plurality of terminal holes 12, and the main body part 11 can be cylindrical in shape. The plurality of terminal holes 12 are disposed on the main body part 11, and the plurality of terminal holes 12 pass through two ends (a front end and a rear end) of the main body part 11, so that the plurality of terminals 2 can be disposed therein.

The plurality of terminals 2 are each made of a metal material with electrical conductivity, and are disposed on the insulating main body 1. The plurality of terminals 2 can be used as power terminals, signal terminals, etc. The plurality of terminals 2 are correspondingly disposed in the plurality of terminal holes 12, so that the plurality of terminals 2 are disposed on the insulating main body 1. One end (a rear end) of the plurality of terminals 2 can extend through one end (the rear end) of the insulating main body 1, so as to be electrically connected to a first cable 10.

The magnet set 3 is disposed on the insulating main body 1, and can be disposed on the main body part 11. The magnet set 3 can be used to be magnetically attached to a magnet set 102 correspondingly disposed on the mating device (i.e., the connector), so that the connecting device is mated with the mating device through a magnetic attraction.

Figure 9:
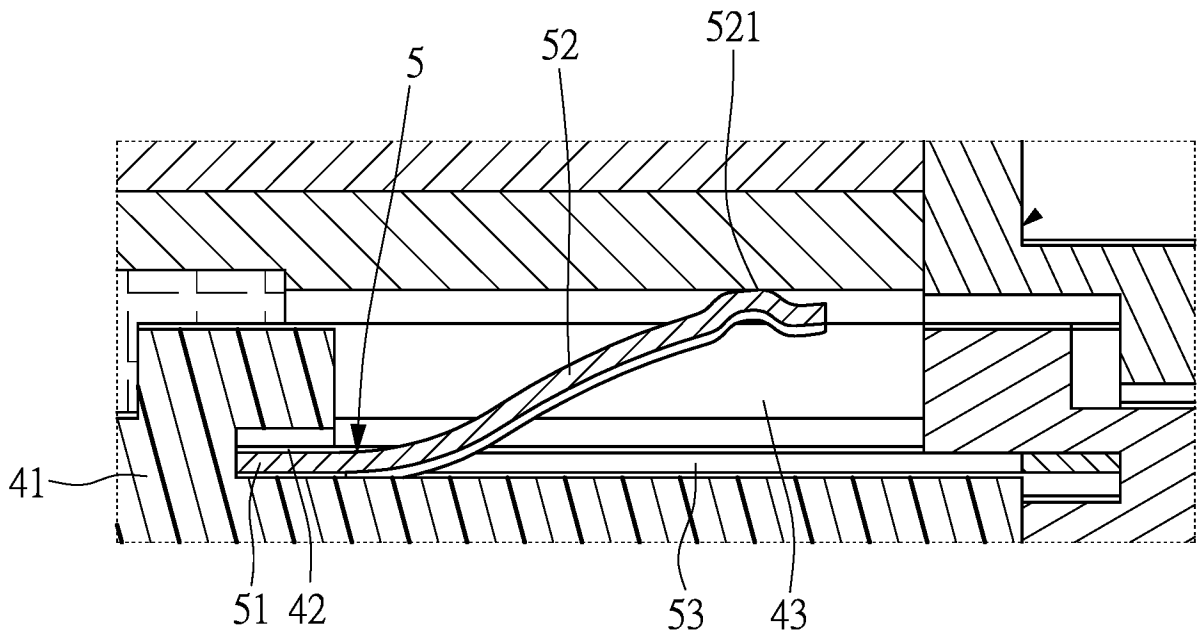
FIG. 9 is an enlarged view of part IX of FIG. 3.
Figure 10:
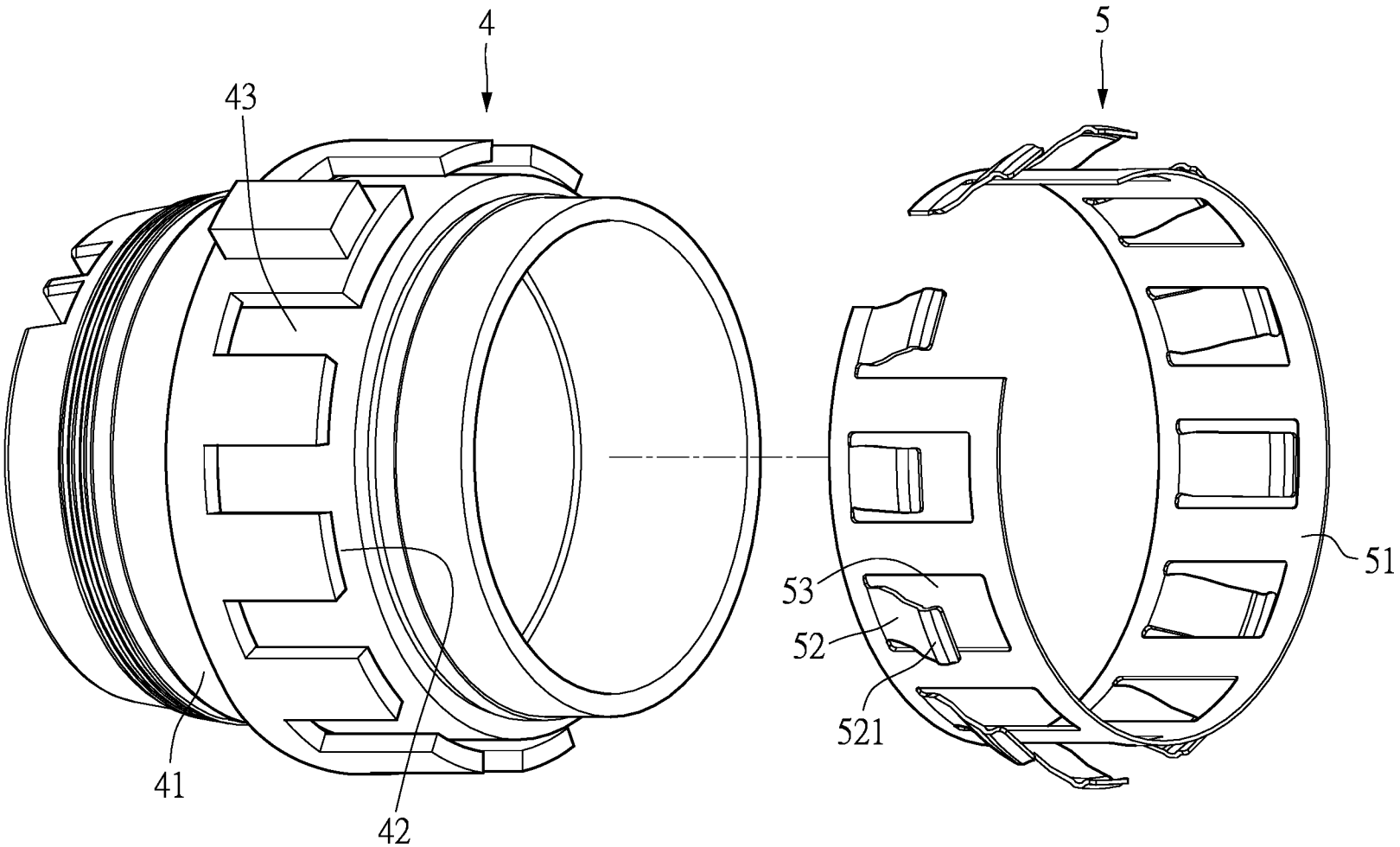
FIG. 10 is a schematic exploded view of an inner housing and a crown leaf spring according to the present disclosure.
Figure 11:
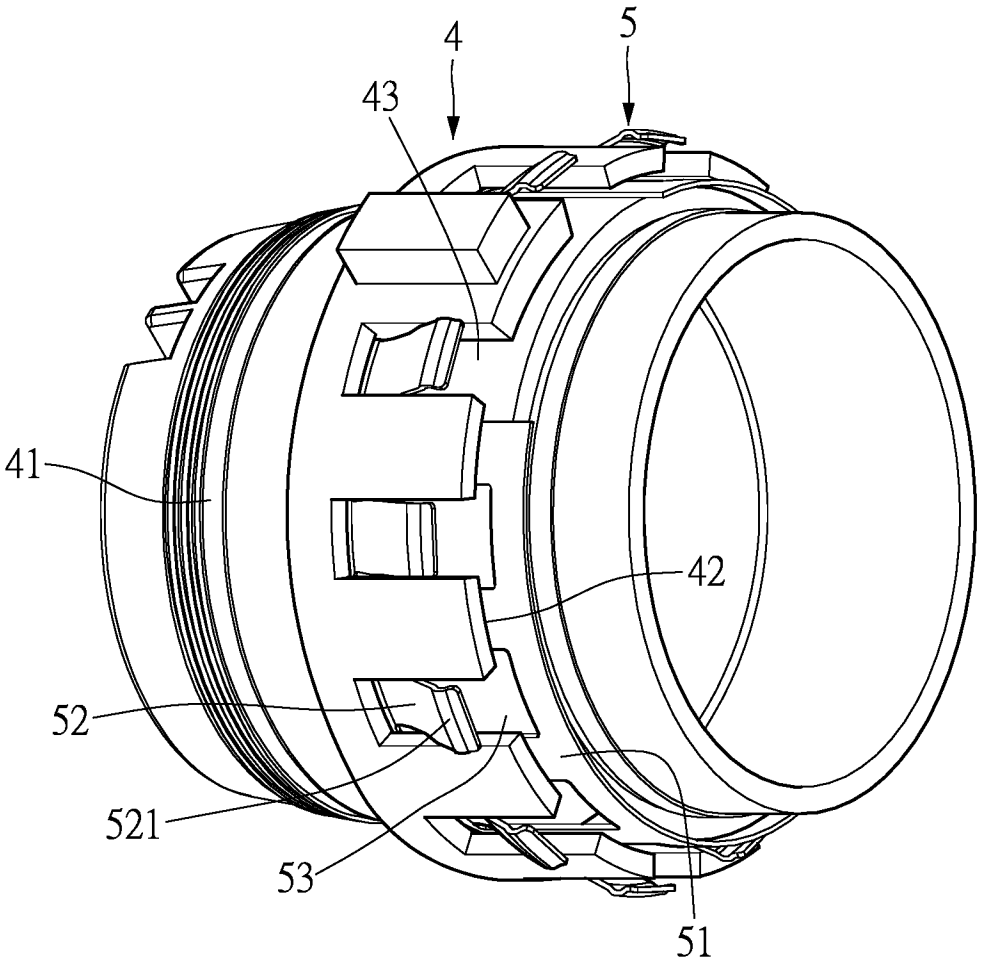
FIG. 11 is a schematic assembled view of the inner housing and the crown leaf spring according to the present disclosure.

The inner housing 4 can be made of the plastic material. The inner housing 4 can have an inner housing main body 41 (as shown in FIG. 9 to FIG. 11). The inner housing main body 41 is a hollow body and can be cylindrical in shape. The inner housing 4 can be sleeved around the insulating main body 1. The inner housing main body 41 can have an accommodating groove 42 and a plurality of openings 43. The accommodating groove 42 is annularly arranged in the inner housing main body 41. One end (a rear end) of the accommodating groove 42 is open to facilitate assembly of the crown leaf spring 5. The plurality of openings 43 are spaced apart from each other on an outer side of the inner housing main body 41, and the plurality of openings 43 are connected to the accommodating groove 42. Preferably, one end (a front end) of the inner housing main body 41 is conical in shape. The inner housing main body 41 can have a plurality of through holes 44 arranged at the one end (the front end), and the plurality of through holes 44 respectively correspond to the plurality of terminals 2, such that mating terminals 101 pass through the corresponding through holes 44 and can be in contact with the corresponding terminals 2.

The crown leaf spring 5 can be made of a metal elastic material (a metal leaf spring). The crown leaf spring 5 has a ring body 51 and a plurality of elastic parts 52. The ring body 51 can be a C-shaped ring body. The plurality of elastic parts 52 are spaced apart from each other on the ring body 51. One end of each of the plurality of elastic parts 52 is connected to the ring body 51, and another end of each of the plurality of elastic parts 52 is bent outwardly and extends through an outer side of the ring body 51, and the plurality of elastic parts 52 can serve as elastic arms. In the present embodiment, the ring body 51 can have a plurality of perforations 53, and the plurality of elastic parts 52 respectively correspond to the plurality of perforations 53. Each of the plurality of elastic parts 52 has a convex camber 521, and the convex cambers 521 of the plurality of elastic parts 52 face an outer side of the crown leaf spring 5. The crown leaf spring 5 is disposed on the inner housing 4, and the ring body 51 of the crown leaf spring 5 can be arranged inside the accommodating groove 42 of the inner housing 4 (as shown in FIG. 9), so that the crown leaf spring 5 is stably disposed on the inner housing 4. The plurality of elastic parts 52 can protrude outside the inner housing 4 through the plurality of openings 43 respectively, and the convex cambers 521 of the plurality of elastic parts 52 are exposed from the inner housing 4.

The outer housing 6 can be made of the plastic material. The outer housing 6 can have an outer housing main body 61. The outer housing main body 61 is a hollow body, and can be cylindrical in shape. The outer housing main body 61 has an accommodating slot 62 arranged on an inner side of the outer housing main body 61, and the accommodating slot 62 can be used to accommodate the wave spring 7, so that the wave spring 7 is stably disposed on the outer housing 6. The outer housing main body 61 can further have a ring-shaped member 63 arranged therein. The ring-shaped member 63 can be made of the metal material, and the ring-shaped member 63 is assembled in the housing main body 61.

The outer housing 6 is sleeved around the inner housing 4, so that the crown leaf spring 5 and the wave spring 7 are disposed between the inner housing 4 and the outer housing 6, and the plurality of elastic parts 52 of the crown leaf spring 5 abut the outer housing 6. In the present embodiment, the plurality of elastic parts 52 abut the ring-shaped member 63. The convex cambers 521 of the plurality of elastic parts 52 abut an inner side of the ring-shaped member 63, so that the crown leaf spring 5 is disposed between the inner housing 4 and the outer housing 6, and the crown leaf spring 5 can be used to hold the inner housing 4, so that the inner housing 4 can be disposed on the outer housing 6 in a floating way. The plurality of elastic parts 52 surround the inner housing 4, that is, the plurality of elastic parts 52 are spaced around the inner housing 4, so that a better floating effect can be achieved through forming a 360-degree multi-point support.

The wave spring 7 (a wave-shaped spring) is an annularly wave-shaped metal leaf spring with elasticity, and provides a space-saving property. The wave spring 7 is disposed in the accommodating slot 62. Two ends of the wave spring 7 respectively abut the inner housing main body 41 and the outer housing main body 61, such that the wave spring 7 is disposed between the inner housing 4 and the outer housing 6. The wave spring 7 abuts the inner housing 4, so that the wave spring 7 can be used in cooperation with the crown leaf spring 5 to hold the inner housing 4, and the inner housing 4 can be disposed on the outer housing 6 in the floating way, thereby providing the better floating effect. The insulating main body 1, the plurality of terminals 2, the magnet set 3, and the inner housing 4 can be elastically held on the outer housing 6 to form a floating member through the crown leaf spring 5 and the wave spring 7, so that the floating member is disposed on the outer housing 6 in the floating way.

In addition, a first colloid 8 can also be disposed between the plurality of terminals 2 and the first cable 10. The first colloid 8 is filled in the inner housing 4, and is encapsulated between the plurality of terminals 2 and the first cable 10, so as to enhance a waterproof effect. A first positioning ring 9 can also be disposed at one end (a rear end) of the inner housing 4 for blocking the crown leaf spring 5 and fixing the crown leaf spring 5 in position, so that the crown leaf spring 5 is stably fixed in position. A second positioning ring 20 can also be disposed at one end (a rear end) of the outer housing 6 for blocking the positioning ring-shaped member 63 and fixing the positioning ring-shaped member 63 in position, so that the positioning ring-shaped member 63 is stably fixed in position, and the second positioning ring 20 can also be pressed on the first positioning ring 9. A waterproof casing 30 can also be sleeved between the one end (the rear end) of the outer housing 6 and the first cable 10, so as to enhance the waterproof effect.

Figure 7:
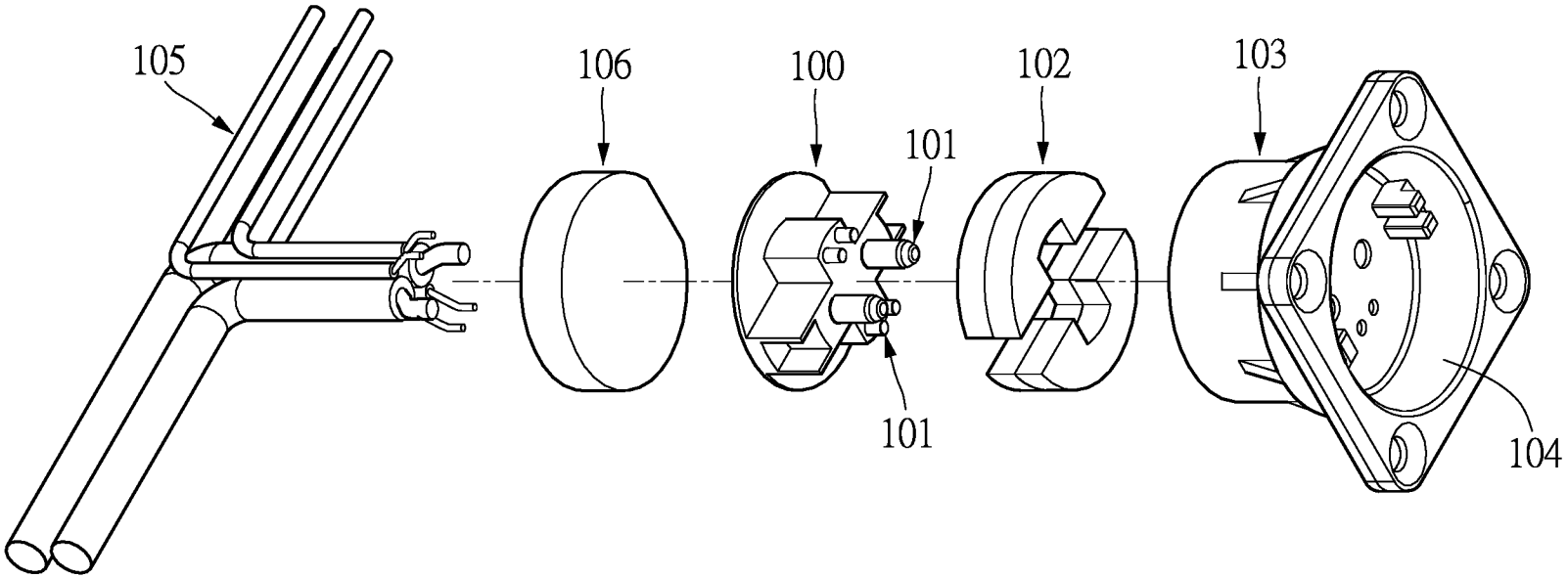
FIG. 7 is a schematic exploded view of the mating device according to the present disclosure.
Figure 8:
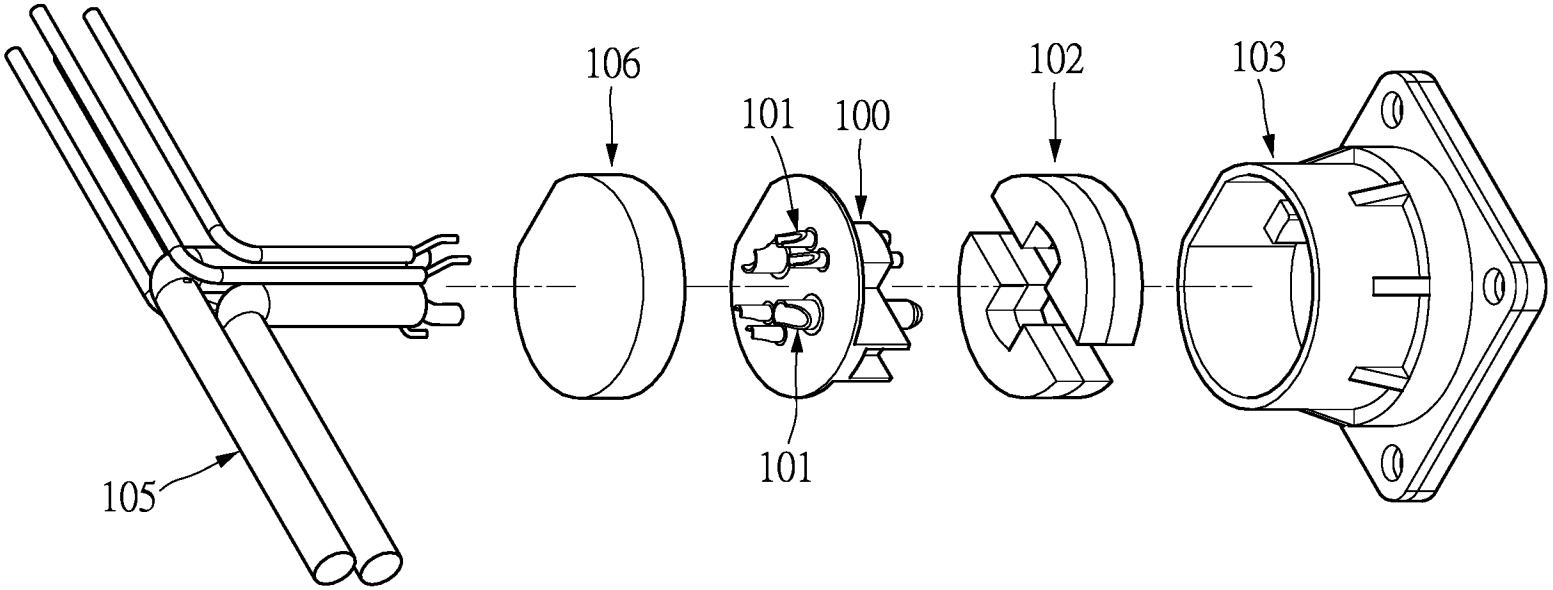
FIG. 8 is a schematic exploded view from another angle of the mating device according to the present disclosure.

The connecting device can be mated with a mating device, such that the connecting device is electrically connected to the mating device for transmitting power and signals. The mating device can include an insulating base body 100, a plurality of mating terminals 101, a mating magnet set 102, and a mating housing 103 (as shown in FIG. 7 and FIG. 8). The plurality of mating terminals 101 are disposed on the insulating base body 100, and the plurality of mating terminals 101 can be used as power terminals, signal terminals, etc. The mating magnet set 102 is disposed on the insulating base body 100, and the mating housing 103 is sleeved around the insulating base body 100. In the present embodiment, the insulating base body 100 has a slot 104, and the slot 104 is conical in shape. A portion of the inner housing main body 41 in proximity to one end of the inner housing main body 41 is conical in shape, and can be mated with the slot 104.

In addition, one end (a rear end) of the plurality of mating terminals 101 can also be electrically connected to a second cable 105, and a second colloid 106 can also be disposed between the plurality of mating terminals 101 and the second cable 105. The second colloid 106 is filled in the mating housing 103, and is encapsulated between the plurality of mating terminals 101 and the second cable 105, so as to enhance the waterproof effect.

As shown in FIG. 3 and FIG. 4, when the connecting device is mated with the mating device, the plurality of terminals 2 are in contact with the plurality of mating terminals 101, so that the connecting device is electrically connected to the mating device. In addition, the magnet set 3 can be fixed to the mating magnet set 102 through a magnetic attraction, so that the connecting device is stably engaged with the mating device. Since the insulating main body 1, the plurality of terminals 2, the magnet set 3, and the inner housing 4 are arranged in a floating state, when the connecting device is mated with the mating device, a guiding effect is provided so that the plurality of terminals 2 can firmly be in contact with the plurality of mating terminals 101. Even in the presence of a greater mechanical tolerance, the corresponding terminals can still be in contact with each other. In the present embodiment, the connecting device is mated with the mating device in the presence of a clearance, and a width of the clearance is, for example, from 0.5 to 1.5 mm. The floating member is moved forward by 0.5 to 1.5 mm by a magnetic attraction-induced compression force of the springs (the crown leaf spring 5 and the wave spring 7). After the connecting device is detached from the mating device, the floating member is returned by a counter-acting force of the compression force of the springs.

Beneficial Effects of the Embodiment

In conclusion, one of the beneficial effects of the present disclosure is that, the connecting device provided by the present disclosure includes the insulating main body, the plurality of terminals, the magnet set, the inner housing, the crown leaf spring, the outer housing, and the wave spring. The crown leaf spring has the ring body and the plurality of elastic parts, and the plurality of elastic parts are disposed on the ring body at intervals. The crown leaf spring is disposed on the inner housing, and the plurality of elastic parts of the crown leaf spring abut the outer housing. The wave spring is disposed between the inner housing and the outer housing, such that the insulating main body, the plurality of terminals, the magnet set, and the inner housing are held on the outer housing by the crown leaf spring and the wave spring to form the floating member. When the connecting device is mated with the mating device, effects of floating and guiding can be provided. The crown leaf spring can be used to hold the inner housing, such that the inner housing is disposed on the outer housing in the floating way. The plurality of elastic parts surround the inner housing, so as to abut the outer housing, thereby forming the multi-point support. In addition, the inner housing is held and disposed on the outer housing in the floating way through the cooperation of the wave spring and the crown leaf spring, so as to achieve better effects in floating and guiding. Accordingly, the terminals of the connecting device are firmly mated with the corresponding terminals of the mating device, so that the corresponding terminals are firmly in contact with each other, resulting in a better electrical transmission.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A connecting device, comprising:

an insulating main body;

a plurality of terminals disposed on the insulating main body;

a magnet set disposed on the insulating main body;

an inner housing having an inner housing main body, the inner housing main body being sleeved around the insulating main body;

a crown leaf spring disposed on the inner housing, the crown leaf spring having a ring body and a plurality of elastic parts, the plurality of elastic parts being disposed on the ring body at intervals;

an outer housing sleeved around the inner housing, the plurality of elastic parts of the crown leaf spring abutting the outer housing; and a wave spring disposed between the inner housing and the outer housing, such that the insulating main body, the plurality of terminals, the magnet set, and the inner housing are held on the outer housing by the crown leaf spring and the wave spring to form a floating member.

2. The connecting device according to claim 1, wherein the inner housing main body has an accommodating groove and a plurality of openings, the accommodating groove is annularly arranged in the inner housing main body, the plurality of openings are spaced apart from each other on an outer side of the inner housing main body, the plurality of openings are connected to the accommodating groove, the ring body of the crown leaf spring is disposed in the accommodating groove, and the plurality of elastic parts protrude outside the inner housing respectively through the plurality of openings.

3. The connecting device according to claim 1, wherein one end of each of the plurality of elastic parts is connected to the ring body, another end of each of the plurality of elastic parts is bent outwardly and extends through an outer side of the ring body, the plurality of elastic parts serve as elastic arms, each of the plurality of elastic parts has a convex camber, the convex cambers of the plurality of elastic parts face an outer side of the crown leaf spring, the convex cambers of the plurality of elastic parts are arranged outside the inner housing, a ring-shaped member is disposed in the outer housing, and the convex cambers of the plurality of elastic parts abut an inner side of the ring-shaped member.

4. The connecting device according to claim 1, wherein one end of the plurality of terminals is electrically connected to a first cable, and a waterproof casing is sleeved between one end of the outer housing and the first cable.

5. The connecting device according to claim 4, wherein a first colloid is disposed between the plurality of terminals and the first cable, and the first colloid is filled in the inner housing and is encapsulated between the plurality of terminals and the first cable.

6. The connecting device according to claim 1, wherein the outer housing has an outer housing main body, an accommodating slot is disposed on an inner side of the outer housing main body, the wave spring is disposed in the accommodating slot, and two ends of the wave spring respectively abut the inner housing main body and the outer housing main body.

7. The connecting device according to claim 1, wherein a first positioning ring is disposed at one end of the inner housing so as to block the crown leaf spring and fix the crown leaf spring in position, and a second positioning ring is disposed at the one end of the outer housing to be used to block the ring-shaped member and fix the ring-shaped member in position.

8. An assembly of a connecting device and a mating device, comprising:

the connecting device including an insulating main body, a plurality of terminals, a magnet set, an inner housing, a crown leaf spring, an outer housing, and a wave spring, wherein the plurality of terminals are disposed on the insulating main body, the magnet set is disposed on the insulating main body, the inner housing has an inner housing main body, the inner housing main body is sleeved around the insulating main body, the crown leaf spring is disposed on the inner housing, the crown leaf spring has a ring body and a plurality of elastic parts, the plurality of elastic parts are disposed on the ring body at intervals, the outer housing is sleeved around the inner housing, the plurality of elastic parts of the crown leaf spring abut the outer housing, and the wave spring is disposed between the inner housing and the outer housing, such that the insulating main body, the plurality of terminals, the magnet set, and the inner housing are held on the outer housing by the crown leaf spring and the wave spring to form a floating member; and the mating device including an insulating base body, a plurality of mating terminals, a mating magnet set, and a mating housing, wherein the plurality of mating terminals are disposed on the insulating base body, the mating magnet set is disposed on the insulating base body, and the mating housing is sleeved around the insulating base body;

wherein, when the connecting device is mated with the mating device, the plurality of terminals are in contact with the plurality of mating terminals, so that the connecting device is electrically connected to the mating device, and the magnet set is fixed to the mating magnet set through a magnetic attraction.

9. The assembly according to claim 8, wherein the inner housing main body has an accommodating groove and a plurality of openings, the accommodating groove is annularly arranged in the inner housing main body, the plurality of openings are spaced apart from each other on an outer side of the inner housing main body, the plurality of openings are connected to the accommodating groove, the ring body of the crown leaf spring is disposed in the accommodating groove, and the plurality of elastic parts protrude outside the inner housing respectively through the plurality of openings.

10. The assembly according to claim 8, wherein one end of each of the plurality of elastic parts is connected to the ring body, another end of each of the plurality of elastic parts is bent outwardly and extends through an outer side of the ring body, the plurality of elastic parts serve as elastic arms, each of the plurality of elastic parts has a convex camber, the convex cambers of the plurality of elastic parts face an outer side of the crown leaf spring, the convex cambers of the plurality of elastic parts are arranged outside the inner housing, a ring-shaped member is disposed in the outer housing, and the convex cambers of the plurality of elastic parts abut an inner side of the ring-shaped member.

11. The assembly according to claim 8, wherein one end of the plurality of terminals is electrically connected to a first cable, and a waterproof casing is sleeved between one end of the outer housing and the first cable.

12. The assembly according to claim 11, wherein a first colloid is disposed between the plurality of terminals and the first cable, and the first colloid is filled in the inner housing and is encapsulated between the plurality of terminals and the first cable.

13. The assembly according to claim 8, wherein the outer housing has an outer housing main body, an accommodating slot is disposed on an inner side of the outer housing main body, the wave spring is disposed in the accommodating slot, and two ends of the wave spring respectively abut the inner housing main body and the outer housing main body.

14. The assembly according to claim 8, wherein a first positioning ring is disposed at one end of the inner housing so as to block the crown leaf spring and fix the crown leaf spring in position, and a second positioning ring is disposed at the one end of the outer housing to be used to block the ring-shaped member and fix the ring-shaped member in position.

15. The assembly according to claim 8, wherein the insulating base body has a slot, the slot is conical in shape, and a portion in proximity to one end of the inner housing main body is conical in shape and is mated with the slot.

16. The assembly according to claim 8, wherein one end of the plurality of mating terminals is electrically connected to a second cable, a second colloid is disposed between the plurality of mating terminals and the second cable, and the second colloid is filled in the mating housing and is encapsulated between the plurality of mating terminals and the second cable.

* * * * *